US006000723A

United States Patent [19]

Fujimoto

[11] Patent Number: 6,000,723

[45] Date of Patent: Dec. 14, 1999

[54] LOOSE-LEAF SHEET AND SYSTEMATIC NOTEBOOK

[75] Inventor: Motoshi Fujimoto, Nishiwaki, Japan

[73] Assignee: Kabushiki Kaisha Nishiwaki Keisan Center, Nishiwaki, Japan

[21] Appl. No.: 08/952,213

[22] PCT Filed: Mar. 10, 1997

[86] PCT No.: PCT/JP97/00782

§ 371 Date: Nov. 19, 1997

§ 102(e) Date: Nov. 19, 1997

[87] PCT Pub. No.: WO97/34770

PCT Pub. Date: Sep. 25, 1997

[30] Foreign Application Priority Data

Mar. 19, 1996 [JP] Japan ..... 8-63187

[51] Int. Cl.[6] ..... B42F 13/00

[52] U.S. Cl. ..... 281/38; 283/81; 281/22

[58] Field of Search ..... 412/79; 281/39, 281/38; 283/81

[56] References Cited

U.S. PATENT DOCUMENTS

| | | | |
|---|---|---|---|
| 3,290,059 | 12/1966 | Newman . | |
| 4,907,904 | 3/1990 | Baldwin | 283/81 |
| 5,090,735 | 2/1992 | Meaney | 283/67 |
| 5,182,152 | 1/1993 | Ericson | 283/81 |
| 5,217,259 | 6/1993 | Wilen | 283/116 |
| 5,421,779 | 6/1995 | Castro | 283/81 |
| 5,573,277 | 11/1996 | Petkovsek | 283/79 |
| 5,795,090 | 8/1998 | Jackson | 281/38 |
| 5,816,730 | 10/1998 | Alspaw et al. | 281/22 |

FOREIGN PATENT DOCUMENTS

| | | |
|---|---|---|
| 2 701 147 | 8/1994 | France . |
| 86 09 554 | 7/1986 | Germany . |

*Primary Examiner*—Andrea L. Pitts
*Assistant Examiner*—Mark Williams
*Attorney, Agent, or Firm*—Oblon, Spivak, McClelland, Maier & Neustadt, P.C.

[57] ABSTRACT

A loose-leaf sheet (1) according to the present invention comprises a base sheet (3) having a binding margin (7) adjacent one edge thereof, and release sheet members (4) affixed onto at least one of opposite faces of the base sheet (3), each of the release sheet members (4) being releasable at least once. A multiplicity of such loose-leaf sheets (1) are bound together to form a systematic notebook such as a memorandum book.

8 Claims, 10 Drawing Sheets

LOOSE-LEAF SHEET AND SYSTEMATIC NOTEBOOK

TECHNICAL FIELD

The present invention relates to a loose-leaf sheet comprising a base sheet and release sheet members releasably affixed onto the base sheet, and to a systematic notebook such as a memorandum book comprising such loose-leaf sheet.

BACKGROUND ART

Memorandum books, in general, have pages with special formats allowing items to be entered therein sortingly by their contents or in the order of their occurrences thereby facilitating orderly entries of different information in different pages. A so-called "systematic memorandum book" is currently the most developed form of memorandum book. Such systematic memorandum book includes special pages having, for example, a schedule column, memorandum column, check list column, client column, account column, diary column and a like column.

These memorandum books have unique utility which is different from that of electronic notebook devices or like devices because the memorandum books enables immediate entry, fast reading-through and offers excellent portability, and because actual writing makes the user hard to forget the matter thus written down.

When an item is to be entered in a conventional memorandum book, the user requires time to sort the item in his or her mind and select a page having a suitable format prior to the entry. Thus, a mere entry involves cumbersome operations such as turning pages.

Further, if the user selects a wrong page, the user has to post an entered item to a right page later with a substantial loss of time and labor.

Additionally, entries of sorted items into different pages make it rather difficult to find out only certain items, for example, unfinished items.

Generally, a finished item is deleted by being entirely marked with a cross mark (X) or struck through with two lines. For this reason, it may be impossible to confirm again the content of an item thus deleted. Also, if unfinished items and finished items are left as mingled, there would arise problems such as oversight of any unfinished item.

With such a conventional memorandum book, the user may have to post items once entered when he or she wishes to put interrelated items together, to separate finished items from unfinished items so as to rearrange the entered items, or to change the order of items entered in one page. In such case the posting work imposes very much labor on the user and, as well, the pages in which the items thus posted had been originally entered may become useless.

The present invention has been accomplished in view of the foregoing circumstances. Accordingly, it is an object of the present invention to provide a loose-leaf sheet and a systematic notebook which allow the user to put items in a desired order with extreme ease while saving time and labor required for posting operations, prevent the user from overlooking any unfinished item, and avoid the occurrence of any useless page thereby enhancing their usefulness.

DISCLOSURE OF INVENTION

The present invention provides the following technical means to attain the above object.

That is, a loose-leaf sheet according to the present invention comprises a base sheet having a binding margin adjacent one edge thereof, and release sheet members affixed onto at least one of opposite faces of the base sheet, each of the release sheet members being releasable at least once.

A systematic notebook according to the present invention may be used as a memorandum book or the like and comprises a plurality of sheets bound at one edge portions thereof, at least one of the plurality of sheets being the loose-leaf sheet defined above.

The base sheet has opposite faces which can be used as two different pages. The release sheet members can be affixed onto each of the two pages of the base sheet or only one of the two pages.

With this construction, when an item entered in a release sheet member becomes finished or unnecessary, such an item can be deleted with ease by simply releasing the release sheet member from the base sheet. This is highly advantageous because there is no need to perform the conventionally required cumbersome operation of deleting finished or unnecessary items by marking the items with a cross mark or striking them through with two lines one by one, and because the portions of the base sheet left after the deletion are kept clean. Additionally, oversight of unfinished items and like problems can be avoided.

Further, as required, direct entry of items in the base sheet which is left after the releasing of the release sheet members is possible and, thus, the release sheet members and the base sheet which constitute a single page can be used individually, or can be of double utility.

Each release sheet member once released from the base sheet may be used for various purposes rather than expected, for example, as a substitute for a tag to be affixed to another document, article, feltboard for illustration or the like, as a substitute for an adhesive tape to fix a torn sheet or to affix a document to a feltboard or the like, and as a substitute for a bookmarker by folding back one end portion of the release sheet member.

One of the requirements of the loose-leaf sheet to be used as a component of a memorandum book or a like carryable book is that the release sheet members enable writing thereon with ordinary writing utensils such as a propelling pencil, a pencil, a ball-point pen and a fountain pen.

If each release sheet member is sized to accommodate to a single line of characters or to form a single block so as to allow entry of a single item therein, the loose-leaf sheet becomes very easy to handle. Further, since the release sheet members are less likely to have a substantial space left blank, it is possible to minimize the occurrence of wasteful release sheet members and the occurrence of useless spaces occupied by such wasteful sheet members on the base sheet.

If the material for affixing the release sheet members to the base sheet comprise any tacky material (inclusive of adhesive) which permits repeated affixing and releasing of the release sheet members, each release sheet member once released can be affixed to a desired portion.

Thus, it is possible, for example, to collect release sheet members bearing interrelated items from different pages or a given page to another page, or to transfer release sheet members bearing finished or unnecessary items to another page provided for storage only and put the remaining release sheet members (bearing unfinished items) closely in a single page, or to change the arrangement of release sheet members in a single page. In addition, such operations can be achieved very easily and rapidly.

The loose-leaf sheet which can be used as above provides an advantage of eliminating all the cumbersome posting operations as well as an advantage of allowing this user to find necessary information out of orderly arranged items rapidly and accurately.

Further, the loose-leaf sheet enables entry of items in a descending order from an upper sheet member to a lower one without giving any attention to unwanted things. More specifically, the loose-leaf sheet provides an advantage that cumbersome operations of sorting each item to be entered and selecting a suitable page can be eliminated.

If the release sheet members are formed of a light-transmitting material such as a transparent material or a translucent material, it is possible to see through the release sheet members anything displayed on a counterpart member, for example, the base sheet to which the release sheet members are affixed.

Thus, a composite format can be formed by superposing the release sheet members on the counterpart member, for example, a square cell pattern by combining vertical ruled lines provided on the base sheet and horizontal ruled lines provided on the release sheet members. Alternatively, the release sheet members can be used as a cover for protecting anything written on a counterpart member.

In these cases the base sheet may be provided with ruled lines, partition lines, classification borders, or the like. Likewise, the release sheet members may be provided with such lines or borders or the like.

Where the release sheet members are formed of a colored transparent material, each release sheet may be used as an alternative to means for highlighting a specified item such as a fluorescent ink pen.

If the opposite faces of the base sheet have respective formats which are vertically symmetric with each other, the loose-leaf sheet can be used as follows.

Where the loose-leaf sheet is held at its binding margin by a binding ring device so as to be turnable over to the right and left, the binding ring device becomes an obstacle to a hand holding a writing utensil in writing on the page situated on the opposite side of the more skillful hand of the user (the page on the left side with respect to a right-handed user), thus making the writing difficult.

To allow the user to write always on pages on the same side as a user's more skillful hand (for example, pages on the right side with respect to a right-handed user), it is only required that the loose-leaf sheet having the aforementioned vertically symmetric formats on its front and reverse pages be upset and inverted when the front page is fully written. The page thus becoming the front page which would otherwise be positioned on the opposite side of the user's more skillful hand remains on the same sides as the more skillful hand. Accordingly, the user can always perform writing on pages positioned on the same side as his or her hand holding a writing utensil without being hindered by the ring device.

If each release sheet member has a width accommodating to that of a line of characters of a typical size and a length smaller than an effective length of the shorter side of the base sheet and equal to or smaller than a half of the effective length of the longer side of the base sheet, such release sheet members can be used in the following two optional manners.

The first one is to affix the release sheet members onto the base sheet with their longitudinal axes aligned along the shorter side of the base sheet, while the second one is to affix the release sheet members on the base sheet with their longitudinal axes aligned along the longer side of the base sheet and with each pair of release sheet members being longitudinally connected to each other.

Thus, it is possible to write and read with the shorter sides of the base sheet assuming the top and bottom sides, or alternatively with the longer sides of the base sheet assuming the top and bottom sides by rotating the base sheet 90° and re-affixing the release sheet members with their orientation rotated 90°.

If the systematic notebook including at least one such loose-leaf sheet according to the present invention is formed into a memorandum book, it offers improved portability and allows for easy orderly arrangement on a bookshelf or the like.

BEST MODE FOR CARRYING OUT THE INVENTION

Figure 1:
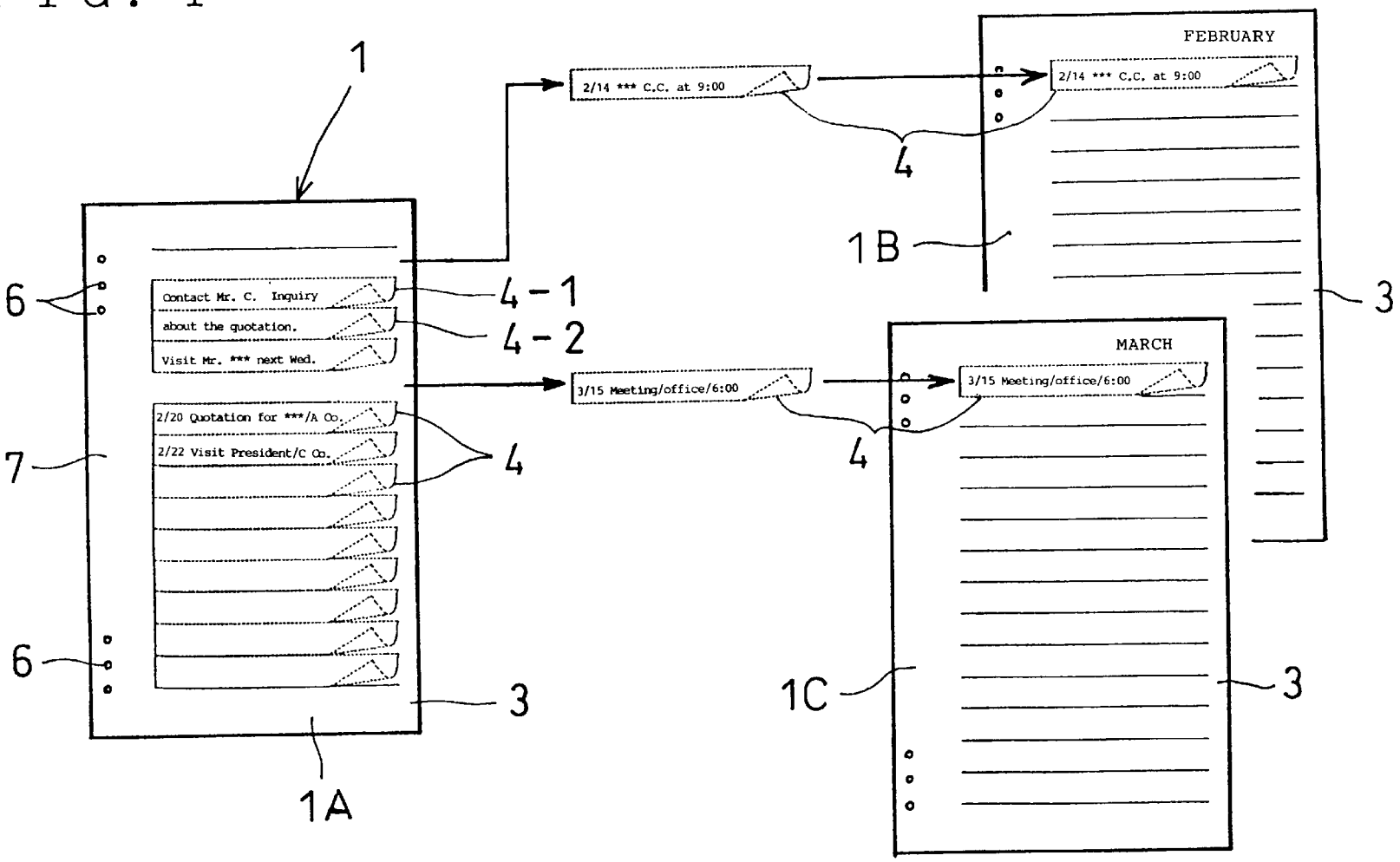
FIG. 1 is an explanatory view illustrating an example of use of a first embodiment of a loose-leaf sheet according to the present invention.

Hereinafter, the present invention will be described by way of embodiments thereof shown in the drawings.

Figure 4:
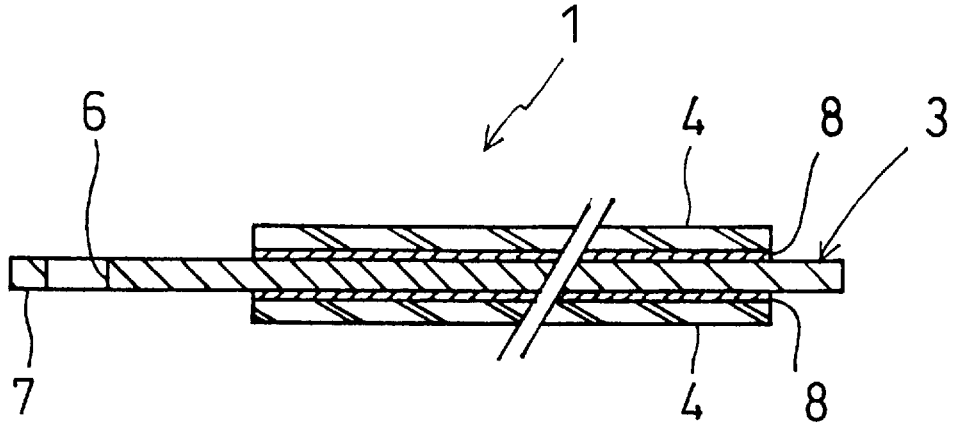
FIG. 4 is an enlarged sectional view taken on line A—A of FIG. 3.
Figure 5:
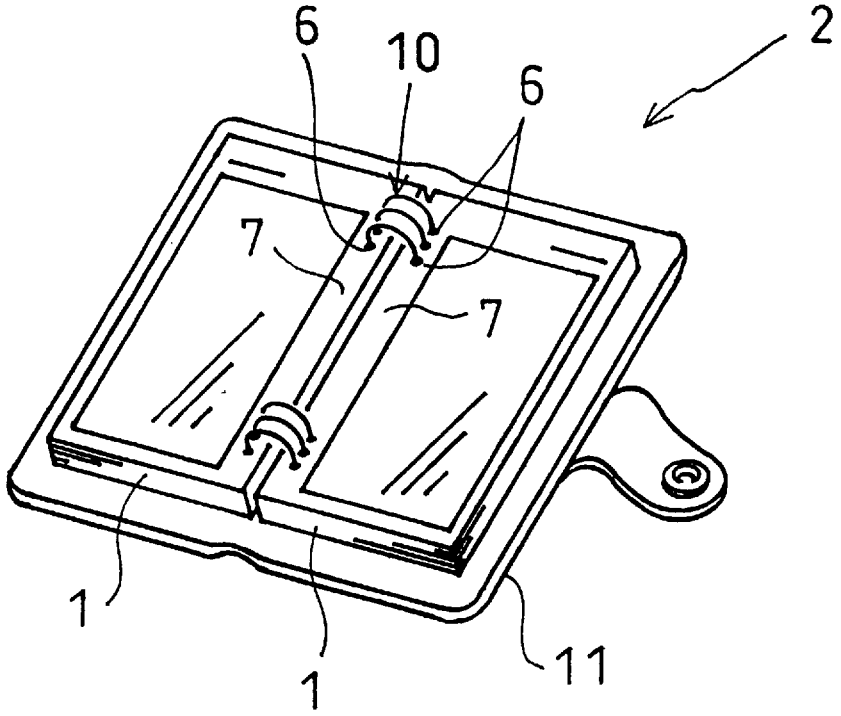
FIG. 5 is a perspective view of an example of a systematic notebook according to the present invention.

FIGS. 1 to 4 illustrate the first embodiment of loose-leaf sheet 1 according to the present invention, and FIG. 5 illustrates systematic notebook 2 including the loose-leaf sheet 1.

Figure 2:
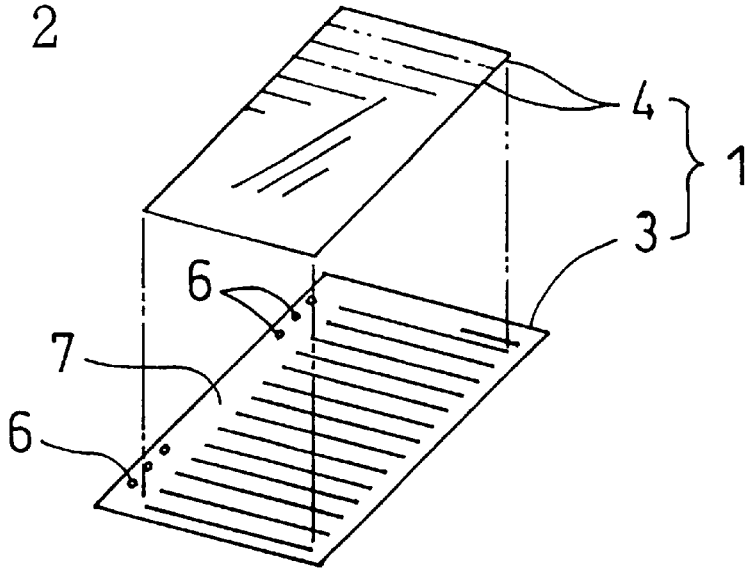
FIG. 2 is an exploded perspective view of the loose-leaf sheet according to the first embodiment.
Figure 3:
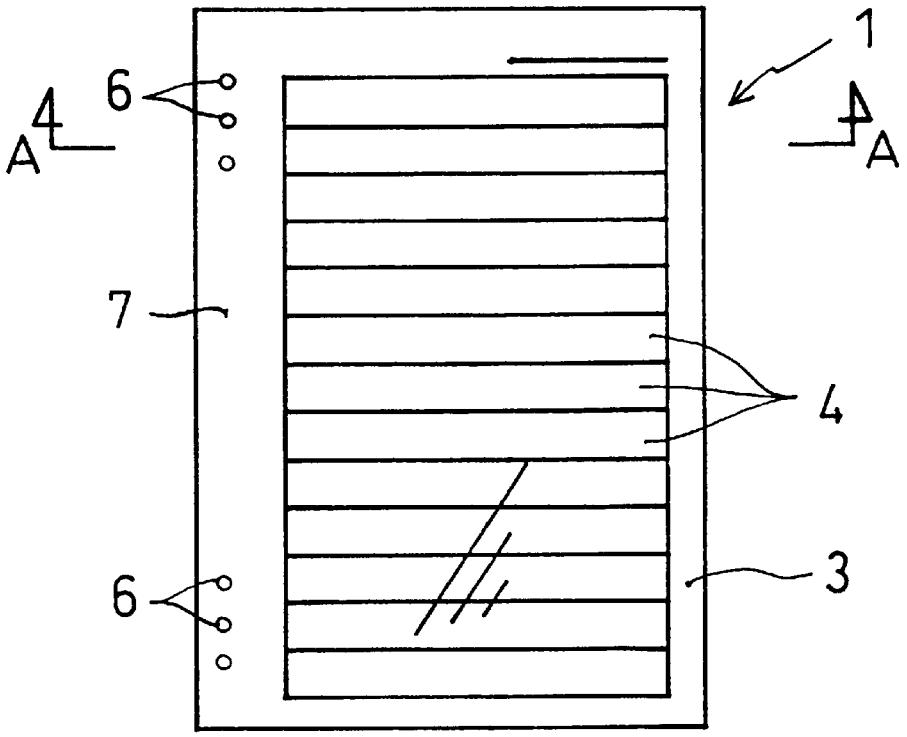
FIG. 3 is a front elevational view of the loose-leaf sheet according to the first embodiment.

As shown in exploded view in FIG. 2, the loose-leaf sheet 1 comprises a base sheet 3 and a plurality of release sheet members 4 affixed to the base sheet 3. As shown in FIG. 4, these release sheet members 4 are affixed to both the front and reverse sides of the base sheet 3 to form two different pages on the front and reverse sides.

The base sheet 3 comprises plain paper as material and having a binding margin 7 adjacent one edge thereof in which a plurality of binding perforations 6 are formed at predetermined intervals. On both the front and reverse sides of the base sheet 7 are provided horizontal ruled lines at predetermined intervals by, for example, printing.

It is possible to vary the number of binding perforations 6, the position of the edge adjacent which the binding margin 7 is provided, the width of the bindings margin 7 and the like depending upon the type, form or the like of the systematic notebook 2. Therefore, the binding margin 7 is not necessarily wider than other marginal spaces provided adjacent other edges. As the case may be, the binding perforations 6 are not provided.

The release sheet members 4 are formed of a light-transmitting material, such as a translucent sheet material including tracing paper or a transparent resin sheet material, which allows writing thereon with ordinary writing utensils such as a propelling pencil, a pencil, a ball-point pen and a fountain pen. Preferably, the release sheet members 4 allow writing or coloring with a marking ink pen, signing pen and fluorescent ink pen but prevent penetration of any ink therethrough.

Each release sheet member 4 is in the form of a narrow strip having a length equal to that of a horizontal ruled line provided on the base sheet 3 and a width equal to the spacing between adjacent horizontal ruled lines. That is, each release sheet member 4 is sized to accommodate to a single line space between adjacent ruled lines provided on the base sheet 3. Thus, multiple release sheet members 4 are affixed adjacent to each other without any clearance therebetween on the front and reverse sides of the base sheet 3, the number of the release sheet members 4 being equal to the number of lines provided on the front and reverse sides of the base sheet 4.

In the manufacture of the loose-leaf sheet 1, it is convenient to take the steps of affixing to this base sheet 3 a large release sheet member forming material sized to cover a predetermined area (whole writing area) on one side of the base sheet 3 and providing cuts in the release sheet member forming material to a depth corresponding to the thickness thereof (without cutting the base sheet 3) to form individual release sheet members 4.

A tacky material 8 is applied to the entire reverse side of each release sheet member 4 to affix each release sheet member 4 to the base sheet 3 (refer to FIG. 4). This tacky material 8 has properties such as to allow repeated affixing and releasing. Further, the tacky material 8 is transparent or translucent so as not to interfere with the light transmitting property of the release sheet member 4.

Multifile 2 as shown in FIG. 5 includes a multiplicity of sheets at least one of which is loose-leaf sheet 1, and a binding ring device 10 binding the sheets together. All the sheets may each comprise such loose-leaf sheet 1.

The binding ring device 10 has rings which accommodate the binding margin 7 of the base sheet 3 in number, shape, spacing between adjacent rings, open/close structure thereof or the like. Such arrangement of the rings may be appropriately varied as long as they are well combined with the base sheet 3. In FIG. 5, numeral 11 designates a cover case.

The following are examples of use of the loose-leaf sheet 1 and systematic notebook 2.

USE EXAMPLE 1

Various necessary items should be entered in release sheet members 4 along ruled lines provided on base sheet 3 which are seen through the release sheet members 4.

In the following description, for convenience, page 1A shown in FIG. 1 will be referred to as "releasing page" provided for entry of items and page 1B or 1C is referred to as "receiving page" for orderly arrangement of the entered items.

In entering items in the releasing page 1A there is no need to pay attention to anything except to start a new line when the next item is to be entered.

As a matter of course, where one item cannot be accommodated in a single line, the next line should be used. Such a situation is best shown by release sheet members 4-1 and 4-2 in FIG. 1. In this case, it is convenient to provide characters, numerals or the like (not shown) indicating continuation or sequence in appropriate portions of adjacent release sheet members 4.

In this way items are entered one after another from the top toward the bottom of the releasing page 1A in a time sequence without necessitating any cumbersome operation such as sorting each item in advance and selecting a suitable page therefor.

In turn, of the release sheet members 4 on the releasing page 1A those bearing items related to, for example, February are selected and released from the base sheet 3 and then affixed to receiving page 1B intended to be exclusively used for the schedule of February in the order of their occurrences from the top toward the bottom of the page 1B. In this case a set of release sheet members 4-1,4-2 having continuity over a plurality of lines should be handled together.

Since a single release sheet member 4 is sized to accommodate to a single line of characters or letters of a typical size, a significant advantage is provided such that it is possible to handle a single item as a unit.

Further, since each release sheet member 4 is unlikely to leave a substantial blank space therein, it is possible to minimize wasteful use of release sheet members 4 and of the space in the base sheet 3 occupied by release sheet members 4.

The receiving page 1B may comprise a base sheet 3 which is initially free of any release sheet member 4 or is affixed with release sheet members 4 to be replaced with written release sheet members 4 of the releasing page 1A. Alternatively, it is possible to utilize as receiving page 1B a separate sheet of a size as large as a large-size notebook or a separate file.

Likewise, release sheet members 4 bearing items related to March are transferred from the releasing page 1A to receiving page 1C to be used exclusively for the schedule of March. By repeating such operations the schedule of each month can readily be made out.

The use of systematic notebook 2 in this way enables orderly arrangement of information as desired rapidly and simply without necessitating any posting operation (i.e., any actual copying operation with a writing utensil), which would otherwise be impossible with conventional memorandum books or the like.

Release sheet members 4 left spaced from each other on the releasing page 1A by releasing some release sheet members 4 therefrom as above may be put close together upwardly with possible rearrangement thereof.

A relatively large blank portion in the lower portion of the base sheet 3 resulting from such operations may be effectively used by, for example, entering a memorandum directly therein when necessity arises.

When all the release sheet members 4 are released from the releasing page 1A, the base sheet 3 thus left may be reused as a new receiving page or as a sheet allowing direct 16 entry therein. Thus, release sheet members 4 and the base sheet 3 on the same page have individual utility values, i.e., the loose-leaf sheet 1 is of double utility value.

USE EXAMPLE 2

When some items borne by release sheet members 4 on receiving page 1B in which the schedule of, for example, February is made out in the manner as described in Use Example 1, becomes finished or unnecessary, these release sheet member 4 are released from the base sheet 3 and then affixed to another page to be used for storage only (not shown). Release sheet members 4 (with unfinished items) thus left spaced on the receiving page 1B are put close together upwardly on the base sheet 3.

In this way finished or unnecessary items are readily deleted from the receiving page 1B without requiring any cumbersome erasing operation such as marking each item with a cross mark or striking each item through with two lines. Further, since no such erasing operation is required, both the release sheet members 4 and the base sheet 3 are kept clean even after the deletion of finished or unnecessary items. This results in advantages of finding out a target item rapidly and preventing oversight or the like.

With lapse of days, the number of release sheet members 4 left on the receiving page 1B decreases and, hence, they necessarily become conspicuous. For this reason the items in such release sheet members 4, or unfinished items can be noticed at a glance with no possibility of oversight.

On the other hand, release sheet members 4 with finished or unnecessary items on the storage page (not shown) are necessarily arranged from the top in the order of their settlement. Each of such items can be clearly read because they are not erased with a cross mark or two lines. Thus, there is provided an advantage that later confirmation or search can be made with extreme ease.

USE EXAMPLE 3

When items borne by release sheet members 4 affixed to the receiving page 1B or 1C in which the schedule is completed in the manner as described in Use Example 1, become finished or unnecessary, such release sheet members 4 are released from the base sheet 3 and discarded sequentially. Each time such discard is made the remaining release sheet members 4 with a space therebetween are put close together upwardly.

Eventually, only the base sheet 3 is left on the receiving page 1B or 1C. Thus, it is possible to reuse the base sheet 3 as a new receiving page or as a sheet allowing direct entry therein.

USE EXAMPLE 4

Release sheet member 4 released from base sheet 3 is used as a substitute for a tag by being attached to another document, article, feltboard or the like. If a comment or the like is provided in release sheet member 4, such release sheet member 4 can be used as a message sheet.

USE EXAMPLE 5

Release sheet member 4 released from base sheet 3 is used as a substitute for an adhesive tape in, for example, repairing a torn sheet or attaching a document to a feltboard.

Thus, cumbersomeness such as to carry about adhesive tape for each meeting will be eliminated.

USE EXAMPLE 6

Figure 6:
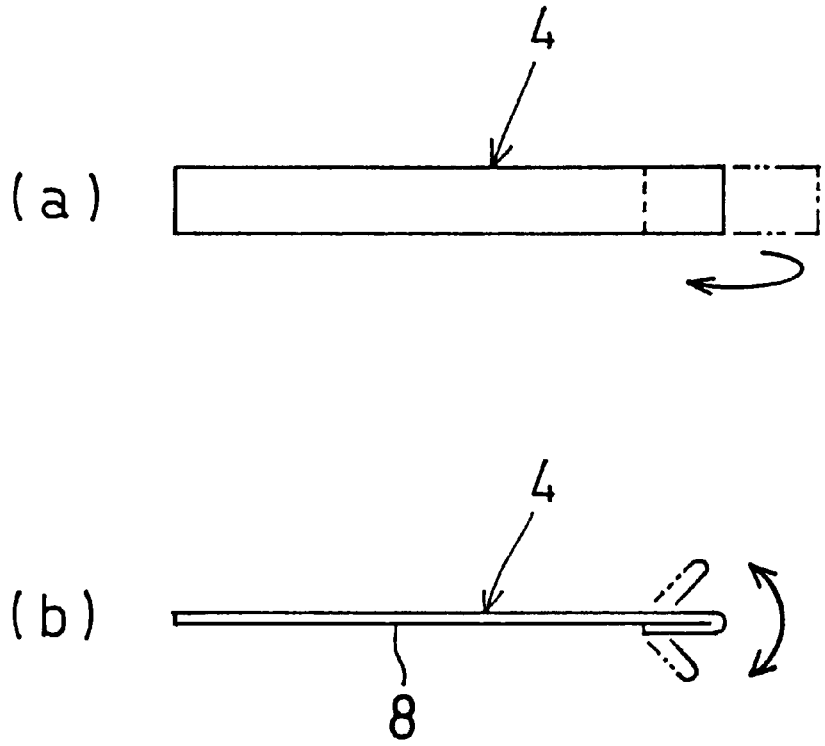
FIG. 6 illustrates an example of adaptation of a release sheet member as used in the first embodiment of the loose-leaf sheet, in which FIGS. 6(*a*) and 6(*b*) are a front view and a side view, respectively, of the release sheet member.

As shown in FIGS. 6(*a*) and 6(*b*), release sheet member 4 released from base sheet 3 is folded back at one longitudinal end thereof and the folded portion is bonded to the corresponding portion of the release sheet member. The release sheet member 4 thus folded is used as a substitute for a bookmarker or the like. The length of the folded portion is determined as desired.

In this way the tacky material 8 is not exposed in the folded portion and hence will not stick to a hand or the like. Further, since the folded portion is thicker than the rest, and thus, is easy to bend, the folded portion can be suitably handled as a pick-up tongue.

USE EXAMPLE 7

Release sheet 4 released from base sheet 3 is used as a substitute for a protective cover by being superposingly affixed onto a portion of another document in which a memorandum or the like is written down. Such use of the release sheet member 4 is convenient, for example, where the user does not wish erroneous erasing, staining or damaging of the memorandum, or where the memorandum is written with an aqueous ink and the user wishes to prevent the aqueous ink from feathering or staining another article.

USE EXAMPLE 8

Release sheet member 4 released from base sheet 3 is used as a substitute for a blind by being superposingly affixed onto a portion of base sheet 3 or another document in which a memorandum is written down or a specified portion of printing and painted out with an opaque coloring ink (for example, black marking ink). Such use of release sheet member 4 makes it possible to keep information secret during a specified period of time or from a specified person. When the secrecy becomes unnecessary, the release sheet member 4 may be removed.

USE EXAMPLE 9

A desired title is entered in release sheet member 4 affixed to base sheet 3 and then the resulting release sheet member 4 is transferred onto a cassette tape, cassette video tape, floppy disk or their case, or the back side of any file. In this way the release sheet member 4 is used as a substitute for a label.

Figure 7:
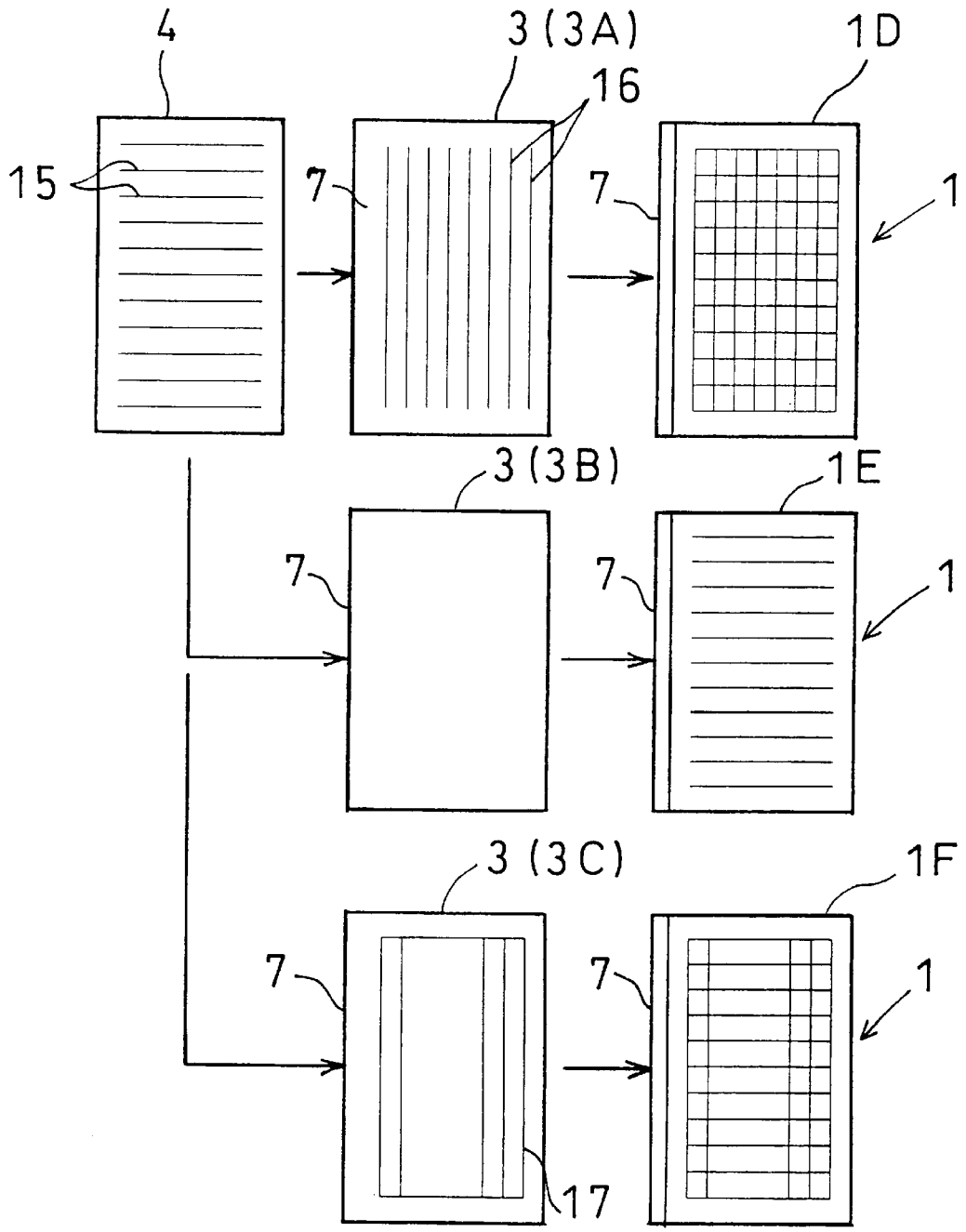
FIG. 7 is an exploded explanatory view showing a second embodiment of a loose-leaf sheet in various combinations according to the present invention.

FIG. 7 shows a second embodiment of loose-leaf sheet 1 according to the present invention. In this embodiment are provided plural types of base sheets 3 (three types 3A,3B,3C are shown) and a single type of release sheet members 4 for use with the plural types of base sheets 3 in common. The release sheet members 4 are used in combination with the different types of base sheets 3 to provide pages with different formats (1D,1E,1F).

The release sheet members 4 used in the second embodiment are connected contiguously to each other to form a single sheet sized to cover a predetermined area (whole writing space) on one side of a base sheet 3.

Cuts (not shown) are provided to define individual writing lines, so that individual release sheet members 4 can be separated one by one when required.

Each release sheet member 4 is provided with a ruled line 15 along and adjacent one longer edge thereof by printing or the like. Thus, when the plural release sheet members 4 are regarded as an integral sheet, each ruled line 15 represents each writing line. When each release sheet member 4 is regarded as a separate individual sheet, the ruled line 15 thereof corresponds to an underline.

The base sheets 3 include one (3A) provided with a plurality of regularly spaced vertical ruled lines 16, a blank one (3B), one (3C) with specific classification borders 17, and the like (not shown).

When the integral sheet of release sheet members 4 is superposingly affixed onto base sheet 3 (3A) having vertical ruled lines 16, the horizontal ruled lines cf the integral sheet and the vertical ruled lines of the base sheet 3 are combined with each other as crossing at right angles to provide page 1D having a square cell pattern format.

Likewise, when the integral sheet of release sheet members 4 is superposingly affixed onto blank base sheet 3 (3B), there is provided page 1E of a format having the horizontal ruled lines 15 only.

Similarly, the integral sheet of release sheet members 4 is superposingly affixed onto base sheet 3 (3C) having the classification borders 17, there is provided page 1F of a format having a table pattern adapted for a predetermined purpose.

USE EXAMPLE 1

Integral sheets of release sheet members 4 of a single type are combined with plural types (3A to 3C) of base sheets 3, respectively, to provide pages 1D to 1F having all the aforementioned format patterns. Also, the same types (3A to 3C) of base sheets 3 free of release sheet members 4 are provided for use as receiving pages.

In turn, the pages 1D to 1F are used with their patterns suited to respective purposes (i.e., entering items following the format of each page). In orderly arranging entered information by transferring release sheet members 4, base sheet 3 to be used as a receiving page should be of the same type as the base sheet 3 having a corresponding releasing page. Such orderly arrangement of in formation is universally practiced.

USE EXAMPLE 2

Information is entered in, for example, page 1D having the square cell pattern format, with one character in one square cell. When orderly arrangement of the information (transfer of release sheet members 4) is to be performed after the entry, blank base sheet 3B is used as a receiving page. In this way the information transferred to the receiving page by affixing a plurality of release sheet members 4 onto the blank base sheet 3B becomes well streamlined with no vertical line 16 between adjacent characters. Further, since the characters are orderly arranged in the vertical direction, the information on each release sheet member 4 can be read very smoothly and exactly. In addition, release sheet members 4 thus transferred to the receiving page are also neatly arranged in order in terms of their appearance.

As a matter of course, the base sheet 3A left as the releasing page comes to have vertical lines 16 only and, hence, can be used as a sheet for vertical writing. Alternatively, it is possible to use the base sheet 3A as a sheet for horizontal writing by rotating it 90°.

USE EXAMPLE 3

Characters are written on page 1F having the table pattern format with vertical partition lines thereof (portions of the classification border) neglected. To perform orderly arrangement of the information thus entered (transfer of release sheet members 4), blank base sheet 3B is used.

Such a way of use is not proper, and it would be proper to use page 1E having the format of horizontal ruled line pattern only instead of the page 1F having the table pattern format.

However, in case where there is no time to select the proper page or there is no longer page 1E having the format of horizontal ruled line pattern only which is blank or partially blank, the use in the above manner has a merit as a stopgap.

USE EXAMPLE 4

Since each release sheet member 4 has a ruled line 15 extending along the length thereof, it is possible to form an appropriate column, classification border, graph or the like by combining, for example, blank base sheet 3B (i.e., with no release sheet member affixed thereto) with a plurality of (for example, four) blank release sheet members 4. In this case each release sheet member 4 may be cut to an appropriate length as required.

Alternatively, release sheet members 4 may be affixed diagonally to provide diagonal ruled lines.

USE EXAMPLE 5

Release sheet member 4 released from base sheet 3 is superposingly affixed onto a specified item of a description of another document. In this case the ruled line 15 of the release sheet member 4 becomes an underline of the specified item. Such use of release sheet member 4 enables highlighting of a specified item without causing any problem even when the release sheet member 4 is affixed to a document or the like which in general restricts or prohibits any interpolation such as a contract document, a power of attorney document, or goods. Hence, the loose-leaf sheet of this embodiment is of a very high utility value.

Figure 8:
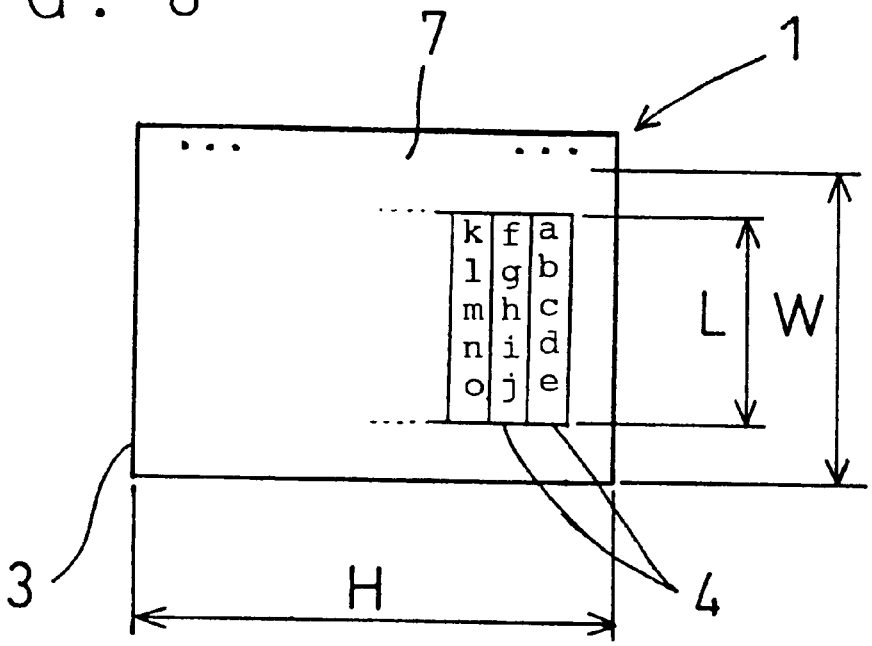
FIG. 8 is a front elevational view of a third embodiment of a loose-leaf sheet (with its longer sides assuming the top and bottom) according to the present invention.
Figure 9:
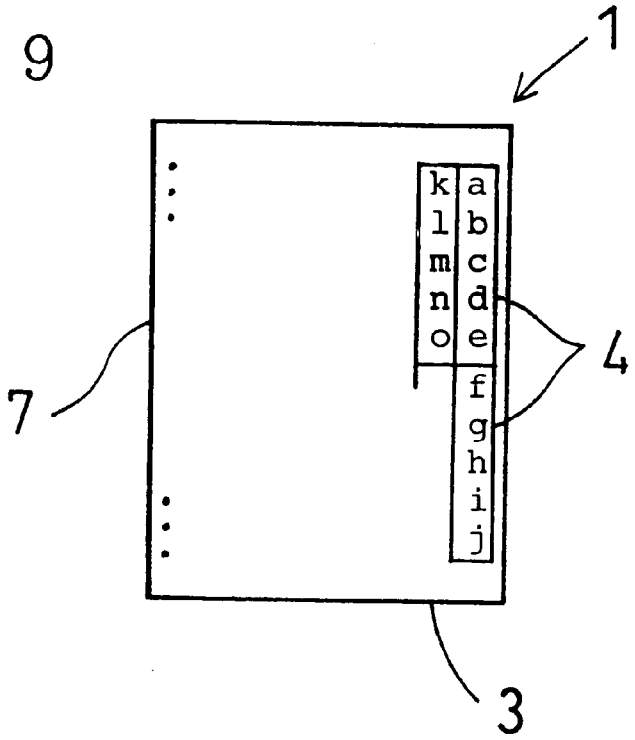
FIG. 9 is also a front elevational view of an example of use of the third embodiment of the loose-leaf sheet (with its shorter sides assuming the top and bottom)

FIGS. 8 and 9 illustrate a third embodiment of loose-leaf sheet 1. Each release sheet member 4 used in the third embodiment is sized to accommodate to a single writing line of characters of typical size. The length L of the release sheet member 4 in the longitudinal direction smaller than effective length W of the shorter side of base sheet 3 (the entire length of the shorter side minus the width of binding margin 7) while being equal to or smaller than a half of effective length H of the longer side of the base sheet 3 (the entire length of the longer side minus the width of binding margin 7 if the binding margin 7 is provided along the shorter side). That is, $W \geqq L \leqq H/2$.

This embodiment employs blank base sheet 3. Whether or not to provide a ruled line in each release sheet member 4 is a matter of option.

USE EXAMPLE

As shown in FIG. 8, the releasing page is used sideways by being rotated 90° and, hence, the writing line direction of each release sheet member 4 is in the vertical direction. Then, entry of information in each release sheet member 4 is performed vertically, i.e., in the line direction thereof.

As shown in FIG. 9, the receiving page is used wholly lengthways. In transferring given release sheet members 4 from the releasing page to the receiving page such release sheet members 4 are affixed onto the receiving page so that the writing line direction of each release sheet member 4 is aligned along the longer side of the receiving page. In this case each pair of release sheet members 4 are vertically connected together to form each single line in such a manner that the first release sheet member is positioned on the upper side of the first line, the second release sheet member positioned on the lower side of the first line, the third release sheet member positioned on the upper side of the second line, and so forth.

In this way the receiving page allows entry of items into the release sheet members 4 and reading of entered items with the shorter sides of the base sheet 3 assuming the top and bottom of the page. This eliminates the cumbersome operation of rotating every page 90° in turning pages or reading the entered items over again later.

Of course, the page shown in FIG. 8 allows entry of items into and reading of the items from the release sheet members 4 affixed thereto with the longer sides of the base sheet 3 assuming the top and bottom of the page.

Figure 10:
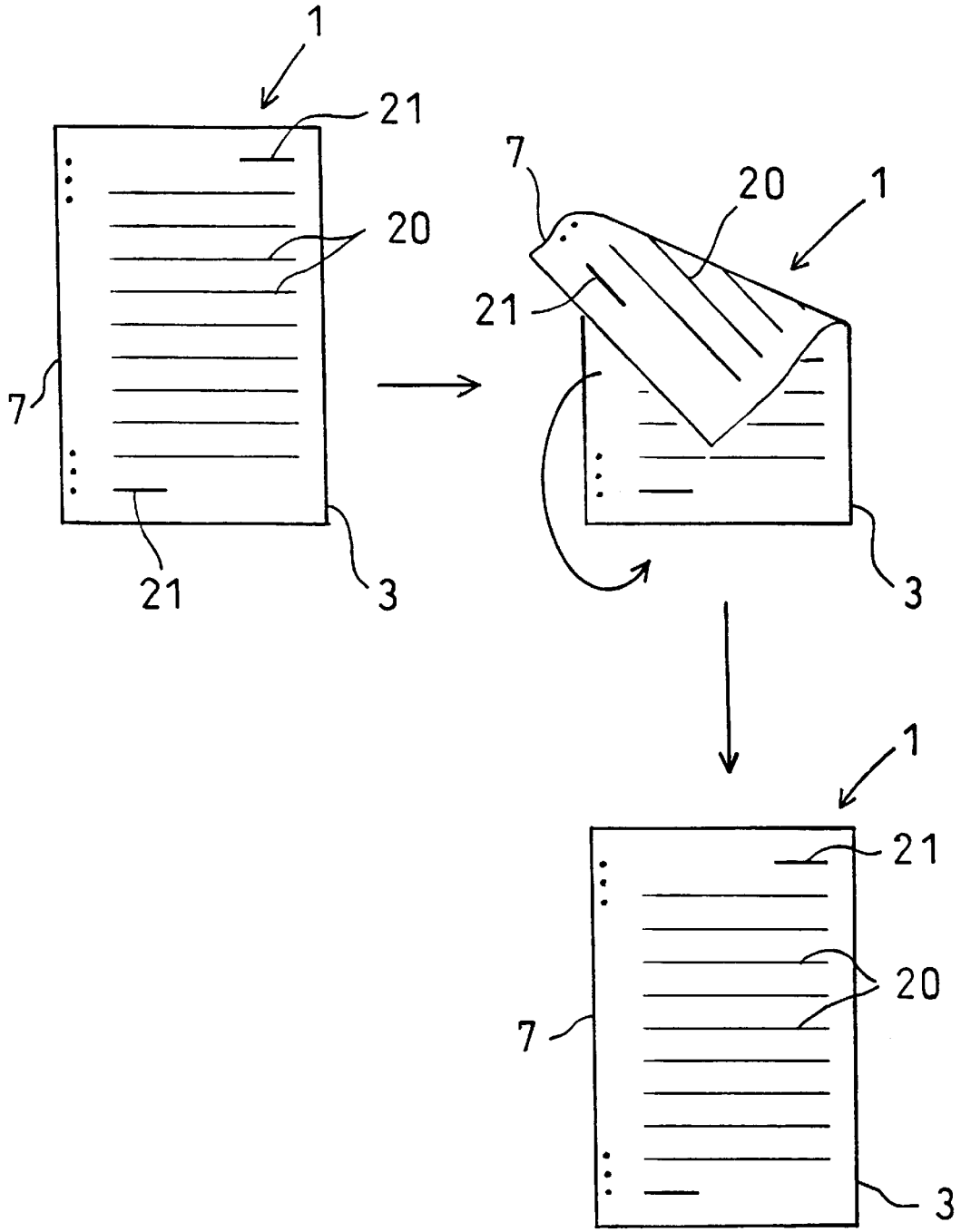
FIG. 10 is an explanatory view illustrating a way of using a fourth embodiment of a loose-leaf sheet according to the present invention.

FIG. 10 illustrates a fourth embodiment of loose-leaf sheet 1 according to the present invention in which release sheet members 4 are not shown. In this embodiment horizontal ruled lines 20 and heading underlines 21 are provided at predetermined intervals on the front and reverse sides of base sheet 3, but the formats of these lines 20 and 21 provided on the front and reverse sides, respectively, of the base sheet 3 are vertically symmetrical with each other.

With this arrangement, when the base sheet 3 is upset in a manner such as to invert the top and the bottom thereof, the format of the ruled lines 20 and underlines 21 appearing on the side having just assumed the front side is the same as on the previous front side.

USE EXAMPLE

Loose-leaf sheets 1 are set on binding ring device 10 of systematic notebook 2 by inserting the rings of the binding ring device 10 into binding perforations 6 provided in binding margin 7 of the base sheet 3 of each loose-leaf sheet 1 as shown in FIG. 5. Thus, the loose-leaf sheet 1 are turnable to the right and left sides of the ring device 10.

Now assuming that the systematic notebook 2 is opened so that loose-leaf sheets 1 are positioned on opposite sides of the ring device 10 and that the user is going to write some characters on the opened page of the loose-leaf sheet 1 positioned on the opposite side of a user's more skillful hand (left page if the user is right-handed).

In this case the ring device 10 becomes an obstacle to a hand holding a writing utensil and, hence, it is difficult for the user to write on that page. However, the ring device 10 does not interfere with the user at all when the user writes characters on the opened page of the loose-leaf sheet 1 positioned on the same side as the user's more skillful hand (right page if the user is right-handed).

To enable the user to write always on pages positioned on the same side as the user's more skillful hand, the page on the front side of a loose-leaf sheet 1 positioned on the same side as the user's more skillful hand is subjected to writing and, when the page is fully written, the base sheet 3 of the loose-leaf sheet 1 is invertedly upset. In this way the loose-leaf sheet 1 thus upset remains on the same as the user's more skillful hand with its page having just assumed the front side being ready to be written.

When the pages on opposite sides of loose-leaf sheet 1 are fully written, this loose-leaf sheet 1 is turned over to the side opposite the user's more skillful hand (for example, to the left). Such an operation is repeated.

Figure 11:
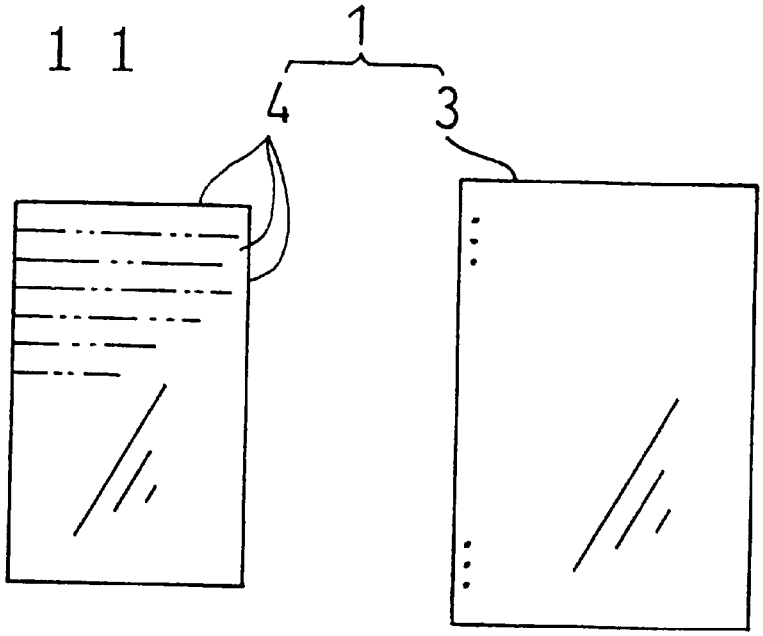
FIG. 11 is an exploded front elevational view of a fifth embodiment of a loose-leaf sheet according to the present invention.
Figure 12:
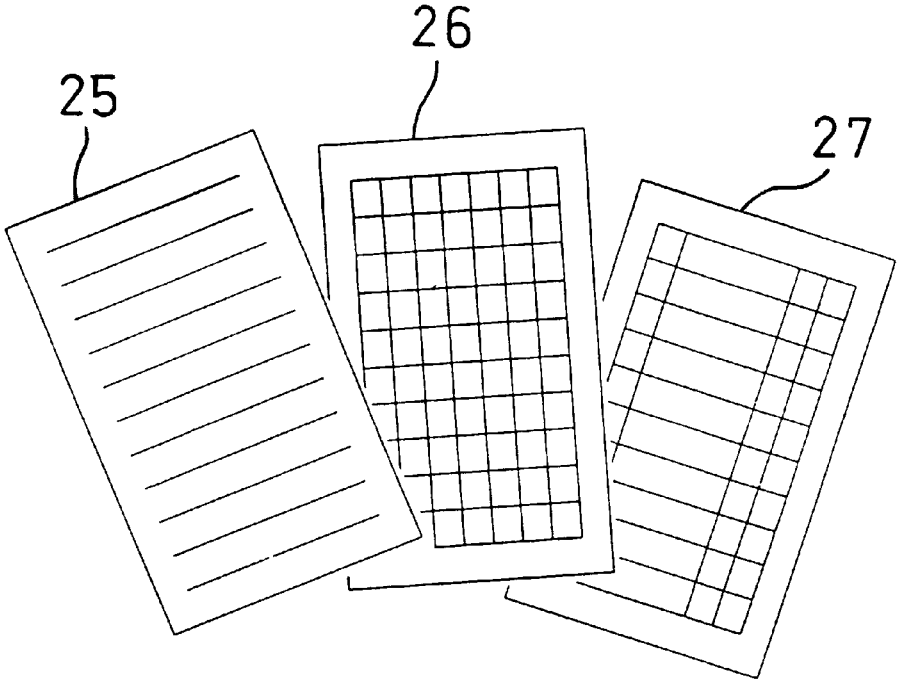
FIG. 12 is a front elevational view showing underlay boards of various patterns to be used in the fifth embodiment of the loose-leaf sheet.

FIG. 11 shows in exploded view a fifth embodiment of loose-leaf sheet 1 according to the present invention. In this embodiment base sheet 3 as well as release sheet members 4 is formed of a light-transmitting material such as transparent, translucent or colored transparent material.

Thus, the loose-leaf sheet 1 comprising the base sheet 3 affixed with the release sheet members 4 allows the user to see the other side of the base sheet 1 therethrough. This loose-leaf sheet 1 has the release sheet members 4 on only one side of the base sheet 3.

USE EXAMPLE 1

In writing characters on such loose-leaf sheet 1 there are used an underlay board 25 having a horizontal ruled line pattern, an underlay board 26 having a square cell pattern and an underlay board 27 having a table pattern adapted for a given purpose.

In this case it is possible to use in combination plural kinds of underlay boards 25 to 27 for a single loose-leaf sheet 1. For example, the underlay board 25 with the horizontal ruled line pattern is used under release sheet members 4 in an upper portion of the base sheet 3, the underlay board 26 with the square cell pattern is used under release sheet members 4 in an intermediate portion of the base sheet 3, and the underlay board 27 with the table pattern is used under release sheet members 4 in a lower portion of the base sheet 3.

In orderly arranging the information entered in these release sheet members 4 (i.e., in transferring the release sheet members 4) it is merely required that the release sheet members 4 be transferred to corresponding receiving pages.

With this embodiment there is no need to carry about plural sets of loose-leaf sheets 1 of different format patterns but a single set of underlay boards 25 to 27 which is accommodated to any pattern. Thus, this embodiment is excellent in portability.

Further, since there is no need to prepare release sheet members 4 and base sheets 3 of different patterns, the subject embodiment is also advantageous in terms of lower manufacturing costs.

USE EXAMPLE 2

Loose-leaf sheet 1 is superposed on a map, drawing, photograph, illustration or the like, and a necessary portion thereof is traced on release sheet members 4. All the release sheet members 4 containing the tracing region can be transferred to, for example, another sheet with their positional sequence on the base sheet 3 maintained.

Alternatively, it is possible to affix release sheet members 4 from the base sheet 3 directly to a map or the like, followed by tracing. In this case the release sheet members 4 affixed onto the map or the like will not shift thereby ensuring easy and exact tracing.

Figure 13:
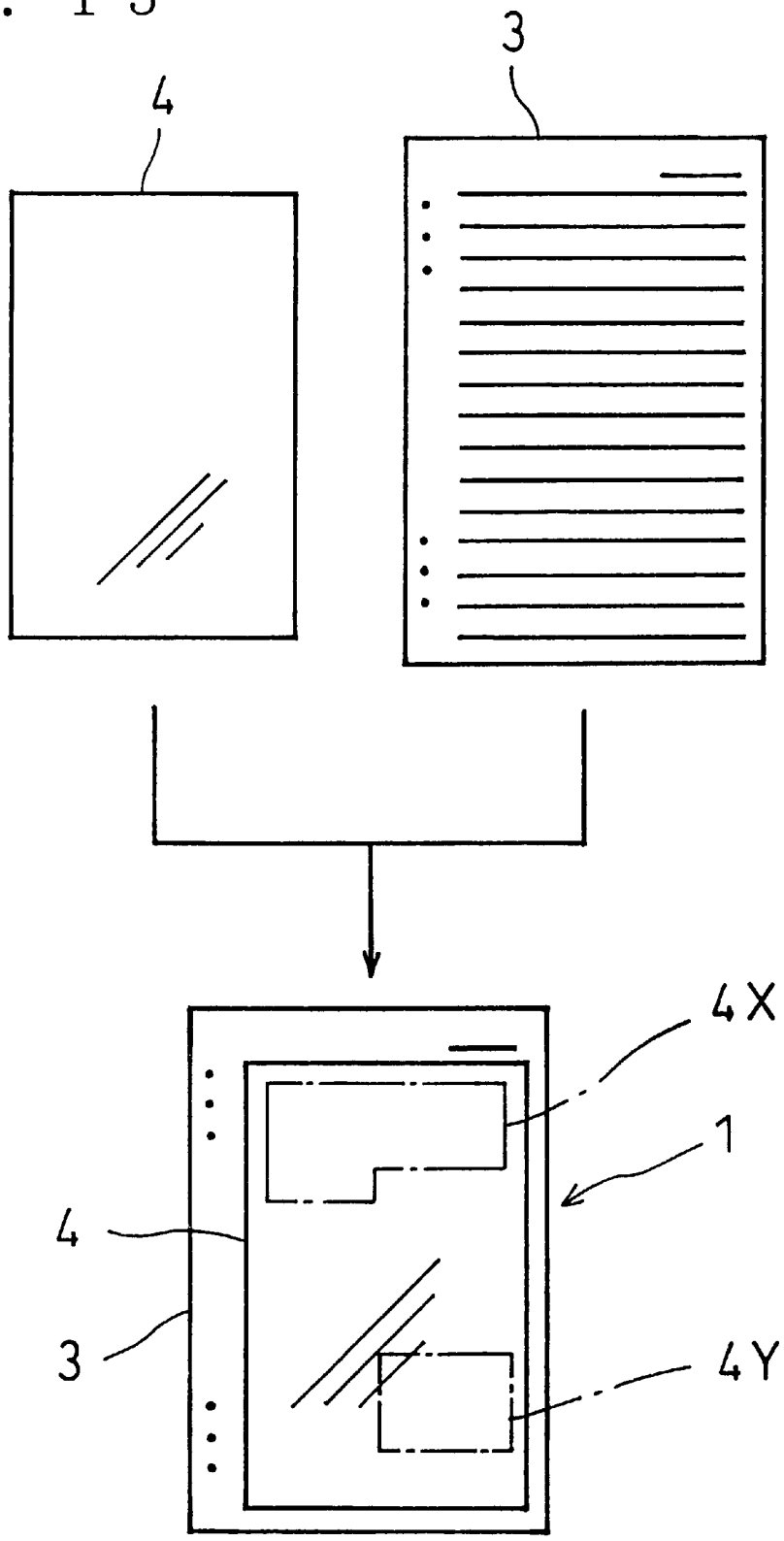
FIG. 13 is a front elevational view of a sixth embodiment of a loose-leaf sheet according to the present invention, together with its exploded views.

FIG. 13 illustrates a sixth embodiment of loose-leaf sheet 1 according to the present invention, in which a single release sheet member 4 is large enough to cover a given area on one side of base sheet 3 (whole writing area) and the base sheet 3 is provided with horizontal ruled lines at predetermined intervals by printing or the like.

USE EXAMPLE

In orderly arranging information entered in the release sheet member 4 in a descending order, portions or areas (refer to the portions designated by 4X and 4Y) containing required pieces of information of the release sheet member 4 are cut off with a single sheet cutter which is capable of cutting a single sheet of stacked sheets and is commercially available.

Figure 14:
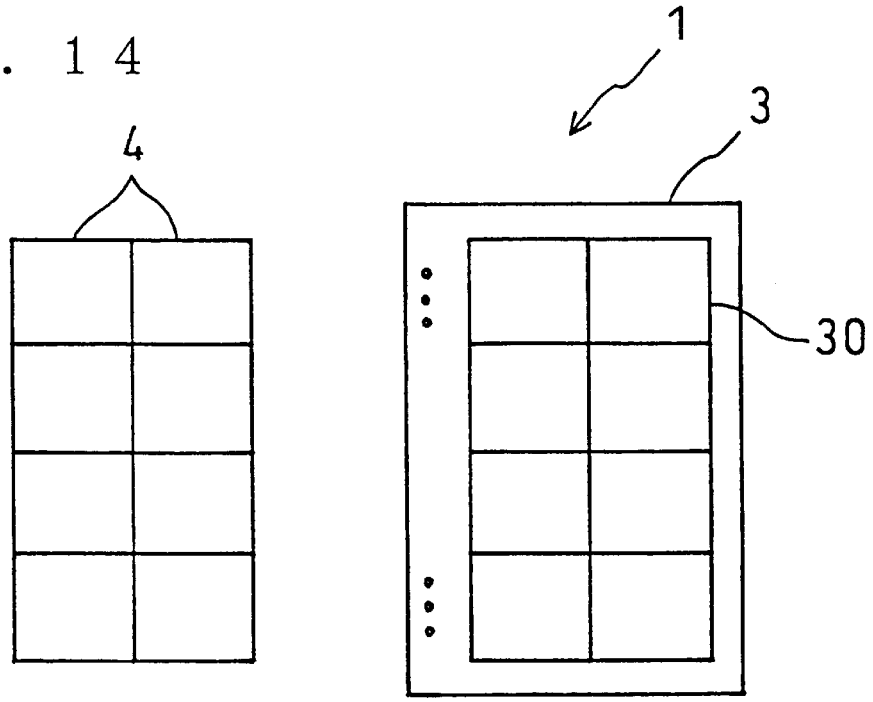
FIG. 14 is an exploded front elevational view of a seventh embodiment of a loose-leaf sheet according to the present invention.

FIG. 14 illustrates a seventh embodiment of loose-leaf sheet 1 according to the present invention, in which release sheet members 4 are each shaped into a block piece and base sheet 3 is provided with partition lines 30 defining sections each corresponding to each release sheet member 4 by printing or the like.

Various variations and modifications as well as the foregoing embodiments are possible in the present invention.

For example, each release sheet member 4 is formed of a colored transparent material and is used, for example, as a substitute for a marker. This is similar to highlighting of a specified item with a fluorescent ink pen.

Thus, release sheet members 4 for use in this case are preferably in a fluorescent color. Further, to prevent such release sheet members 4 from being developed (in black) by a copying machine it is preferable to employ light colors.

It is in general impossible to correct or undo an erroneous marking with a marking ink pen such as a fluorescent ink pen. With a colored transparent release sheet member 4, in contrast, it is advantageously possible to change the affixed position of the release sheet member 4 or undo affixing several times, or to change the marking color (i.e., by replacing affixed release sheet member 4 with a differently colored one).

Further, it is possible for such release sheet member 4 to highlight a specified item without causing any problem even when the release sheet member 4 is affixed to a document or the like which in general restricts or prohibits any interpolation such as a contract document, a power of attorney document, or goods.

Release sheet members 4 and base sheet 4 in various forms as used in the first to seventh embodiments may be used in appropriate combination, and the foregoing Use Examples may also be appropriately combined.

Loose-leaf sheet 1 is not particularly limited in size and may be as large as a large-sized notebook or a typical memorandum book. Alternatively, loose-leaf sheet 1 may be further reduced in size for women or children.

Each release sheet member 4 may have a width accommodating to that of a plurality of lines (a few lines) of typical size characters. Further, each release sheet member 4 may have a length equal to, for example, a half of the width of base sheet 3, and each pair of such release sheet members 4 may be horizontally connected to each other so as to correspond to a single horizontal writing line.

Figure 15:
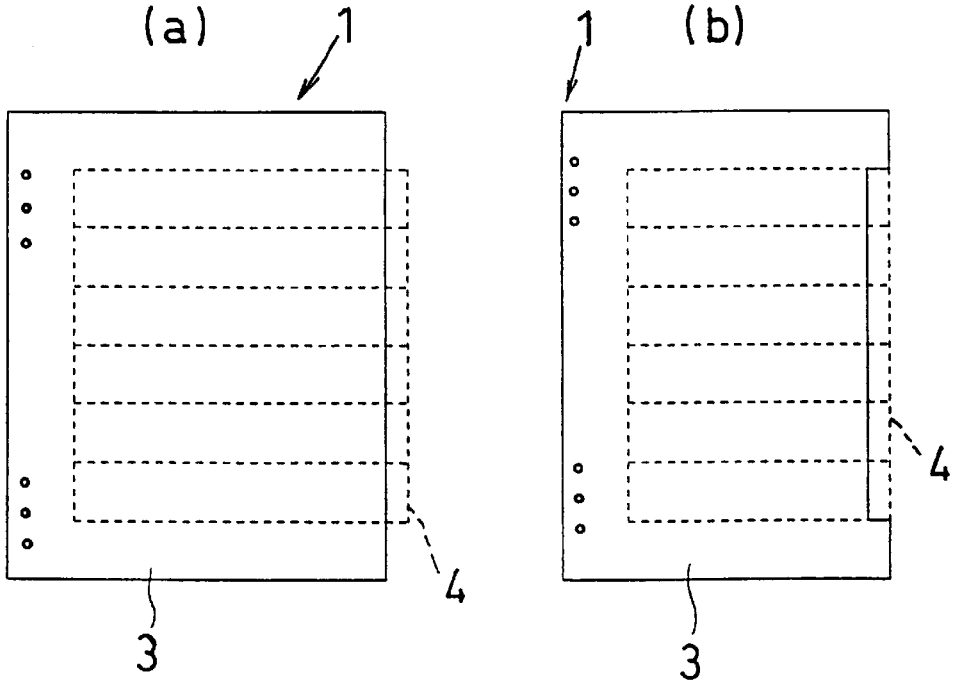
FIG. 15 is a front elevational view of another embodiment of a loose-leaf sheet according to the present invention.

Each release sheet member 4 may have a length such that one end thereof protrudes from a corresponding edge of base sheet 3 as shown in FIG. 15(*a*), or alternatively base sheet 3 has an indented edge such that one end of each release sheet member 4 protrudes therefrom as shown in FIG. 15(*b*). In either case the protruding end portion of each release sheet member 4 is not applied with tacky material 8 so as to allow the user to release the release sheet member 4 easily by taking the protruding end portion thereof by hand.

Tacky material 8 may be such that a single-time releasing causes the tacky material to become incapable of being used again; that is, release sheet member 4 with such tacky material 8 will be disposed of once released from base sheet 3. Tacky material 8 may be a releasable adhesive. Further, tacky material 8 is not required to be applied onto entire one side face of each release sheet member 4 but may be applied partially. Each release sheet member 4 may have one end free of tacky material 8 which functions as a pick-up tongue for releasing.

Each release sheet member 4 may be colored and opaque, or provided with shadowing or any attached printing such as of an illustration or user's name and position (equivalent to user's business card). As such, the present invention has a very extensive applicability.

Base sheet 3 is not limited to a plain paper sheet allowing entry of information with a pencil, ball-point pen or a like writing utensil but may comprise a paper sheet laminated with a film, a plastic sheet or a like sheet.

INDUSTRIAL APPLICABILITY

The loose-leaf sheet according to the present invention is applicable to systematic memorandum books, notebooks and the like.

I claim:

1. A loose-leaf sheet comprising:

a base sheet having a binding margin adjacent one edge thereof, the base sheet being provided with lines selected from the group consisting of: ruled lines, partition lines, and classification borders; and a large release sheet affixed to a surface of the base sheet and sized to cover a predetermined area of the base sheet, the large release sheet having a plurality of cuts therein and including smaller release sheet members affixed to the base sheet and connected contiguously to form a surface of the large release sheet, the smaller release sheet members being defined by respective of the plurality of cuts such that each of the smaller release sheet members is individually removable from the base sheet and from the rest of the large release sheet, the smaller release sheet members being formed of a substantially transparent material, the smaller release sheet members being provided with lines selected from the group consisting of: ruled lines, partition lines, and classification borders, the lines of the smaller release sheet members being superimposed over the lines of the base sheet so that the lines of the base sheet are visible through the large release sheet to form a composite pattern with the lines of the smaller release sheet members.

2. The loose-leaf sheet as set forth in claim 1, wherein the smaller release sheet members are formed of a material which allows writing thereon with an ordinary writing utensil.

3. The loose-leaf sheet as set forth in claim 2, wherein each of the smaller release sheet members is sized to accommodate to a single line of characters or to form a single block.

4. The loose-leaf sheet as set forth in claim 3, wherein the smaller release sheet members are affixed onto the base sheet with a tacky material which permits repeated affixing and releasing of the smaller release sheet members.

5. The loose-leaf sheet as set forth in claim 1, wherein the smaller release sheet members are formed of a transparent material.

6. The loose-leaf sheet as set forth in claim 5, wherein the transparent material is colored.

7. The loose-leaf sheet as set forth in claim 1, wherein the opposite faces of the base sheet have respective formats which are vertically symmetric with each other.

8. The loose-leaf sheet as set forth in claim 1, wherein each of the smaller release sheet members has a width accommodating to that of a line of characters and a length smaller than an effective length (W) of a shorter side of the base sheet and equal to or smaller than a half of an effective length (H) of a longer side of the base sheet.

* * * * *